US009568281B1

(12) United States Patent
Chen

(10) Patent No.: US 9,568,281 B1
(45) Date of Patent: Feb. 14, 2017

(54) QUICK LOCKING SYSTEM

(71) Applicant: Xiao Ming Chen, Tai Shan (CN)

(72) Inventor: Xiao Ming Chen, Tai Shan (CN)

( * ) Notice: Subject to any disclaimer, the term of this patent is extended or adjusted under 35 U.S.C. 154(b) by 0 days.

(21) Appl. No.: 14/544,383

(22) Filed: Dec. 31, 2014

Related U.S. Application Data

(60) Provisional application No. 61/923,176, filed on Jan. 2, 2014.

(51) Int. Cl.
*F41G 11/00* (2006.01)
*F41A 23/08* (2006.01)

(52) U.S. Cl.
CPC ..... *F41G 11/001* (2013.01); *F41A 23/08* (2013.01); *F41G 11/003* (2013.01)

(58) Field of Classification Search
CPC ..... F41G 11/001; F41G 11/003; F41G 11/004; F41G 11/005; F41G 11/006; F41G 11/007; F41G 11/008; F41A 23/08
USPC ..... 42/124; 248/689
See application file for complete search history.

(56) References Cited

U.S. PATENT DOCUMENTS

| | | | | |
|---|---|---|---|---|
| 7,735,255 | B1 * | 6/2010 | Kincaid | F41G 1/35 362/110 |
| 8,336,247 | B2 * | 12/2012 | Haering | F41G 11/003 42/111 |
| 8,857,097 | B2 * | 10/2014 | Rorick | F41G 11/003 42/114 |
| 2010/0107467 | A1 * | 5/2010 | Samson | F41G 11/003 42/127 |
| 2014/0013644 | A1 * | 1/2014 | Trapp | F41G 11/00 42/90 |
| 2014/0305021 | A1 * | 10/2014 | Prieto | F41G 11/003 42/111 |

* cited by examiner

*Primary Examiner* — Stephen M Johnson
(74) *Attorney, Agent, or Firm* — M. Paul Hendrickson

(57) ABSTRACT

A readily attachable and detachable firearm attachment for mounting firearm accessories to a firearm forearm rail is provided by an attachment having a pair of rail clamping and locking jaws. At least one of the jaws is a movable jaw actuated by a levered cam equipped with a locking system to lock and anchor the attachment to the firearm rail and a quick release for unlocking the cam to permit a release of the jaws from the rail.

24 Claims, 21 Drawing Sheets

QUICK LOCKING SYSTEM

CROSS-REFERENCE TO RELATED APPLICATION

This application is a non-provisional application of provisional application 61/923,176 filed Jan. 2, 2014 bearing the same title, the contents of which are incorporated herein and made a part of this application in their entirety.

FIELD OF INVENTION

This invention relates to firearm mounting devices and more particularly to a locking attachment mount for firearms and the use thereof.

BACKGROUND OF INVENTION

Automatic rifles such as the AR-15 style are typically equipped or adapted to be equipped with a relatively rigid plastic or metal piece commonly (referred to as a rail) equipped to mount onto a rifle forearm. The rifle forearm generally encases a forward portion of the firearm in AR-15 style rifle barrels. These mounting rails may be defined as having a ribbed outer surface having a repetitive sequence of cross-wise ribs separated by recessed box-shaped valleys. The ribs are often equipped with a pair of longitudinally ribs or flanged overhangs extending along its sidewalls. The rails serve as a mounting site for a host of rifle accessories.

These mounting rails may be provided with the manufactured firearm or may be subsequently added as a forearm attachment to AR-15 rail mounts. The rails (typically mounted on top, beneath and along the sidewalls) are particularly useful as a forearm topside mount for rifle accessories typically of a visual and sighting use such as scopes or when mounted to the forearm underside for supportive accessories such as a monopod, bipod, or tripod mount which are typically used to steady the aim of the firearm. All of the currently available mounting rail attachments serving as a mount for auxiliary accessories rely upon cumbersome designs such as the use of set screws or other cumbersome unhandy engaging members requiring attentive care and typically two hands for their assembly onto the rail. Accordingly these exists a need for a rail mounting attachment which may readily attached, set and locked at a desired attachment position. The difficulties in setting and locking a monopod, bipod, or tripod or any other mounted accessory at a desired mounting position becomes even more trying under inclimate conditions such as those encountered under frigid arctic conditions when the user often wears gloves. The present invention provides a mounting device which quickly assembles, locks and unlocks from the rail affording rapid attachment and detachment from the rail.

SUMMARY OF THE INVENTION

The present invention provides a forearm mounting attachment which may be readily mounted and locked onto and unlocked from the forearm rails of AR-15 style firearms. The mounting attachment may be adapted as a forearm mount to mount to a host of rifle accessories. The mounting attachment is particularly adaptable as mounting attachment for mounting scopes, monopods, bipods and tripods to forearm rails of AR-15 type firearms.

The AR-15 style firearms are typically equipped with forearm rails for mounting accessories to the forearm sides as well as on top and below the forearm. These mounting sites typically serve to mount rifle scopes, electronic sensors etc. to the top of the forearm whereas accessories mounted underneath the forearm are particularly useful for mounting gun stabilizing attachments such as monopods, bipods, and tripods. In an AR-15 style rifle these mounts for mounting accessories are commonly referred to as a "rail."

The mounting attachment of this invention includes at least one gripping jaw or clamping member which when drawn securely against a forearm rail firmly seats the jaw and attachment to the rail. In a depicted embodiment of the invention, one jaw is pivotally mounted to a main supportive body and the other jaw is set at a fixed position upon the supportive body. Movement of the jaw relies upon a reciprocating rod which draws the jaw to a closed position to firmly secure the attachment to a rail. The attachment includes a levered cam which effectuates movement of the actuating rod to a closed position or open position. The gripping jaw members are laterally positioned at a lateral distance sufficient to securely grip the rail (or any other forearm firearm projection providing a gripping surface) in the closed and locked position and release the grip from the rail when placed in the open position. At least one of the gripping members is operationally connected to the drive unit (e.g. actuating rod) so as to be operationally responsive to reciprocal movement of the drive unit.

The following is a brief description of the Figures which accompany this application.

BRIEF DESCRIPTIONS OF FIGURES

DETAIL DESCRIPTION OF THE INVENTION

Figure 2:
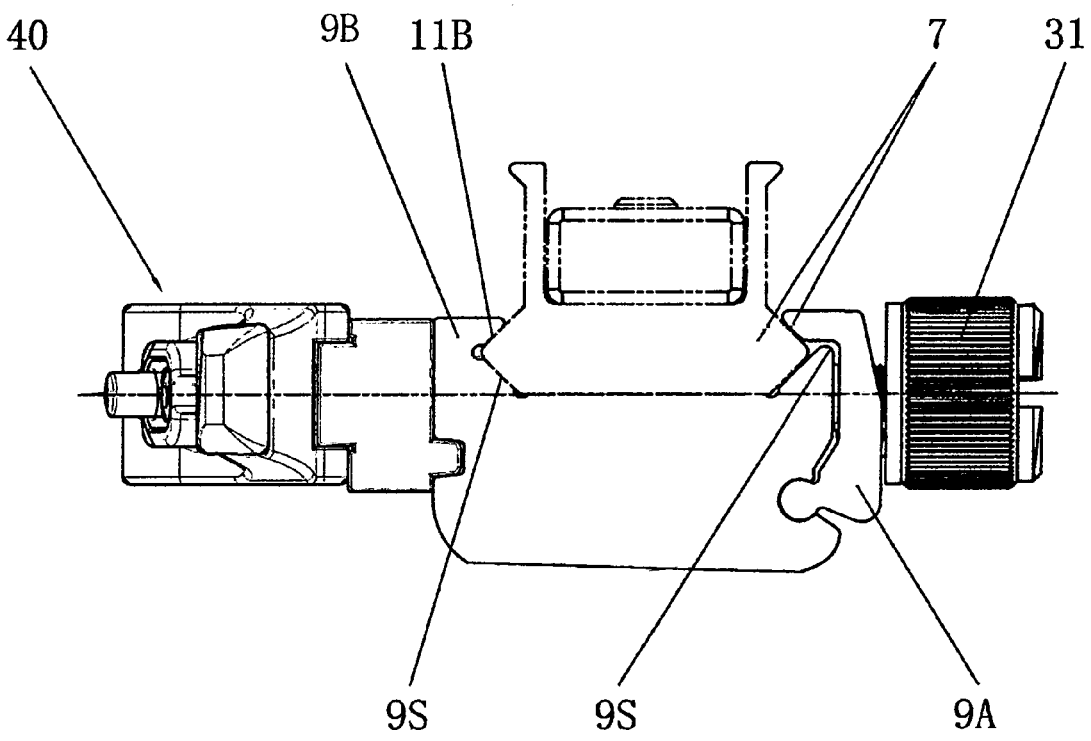
FIG. 2 depicts a frontal view of the device shown in FIG. 1 attached to a forearm firearm rail.
Figure 10:
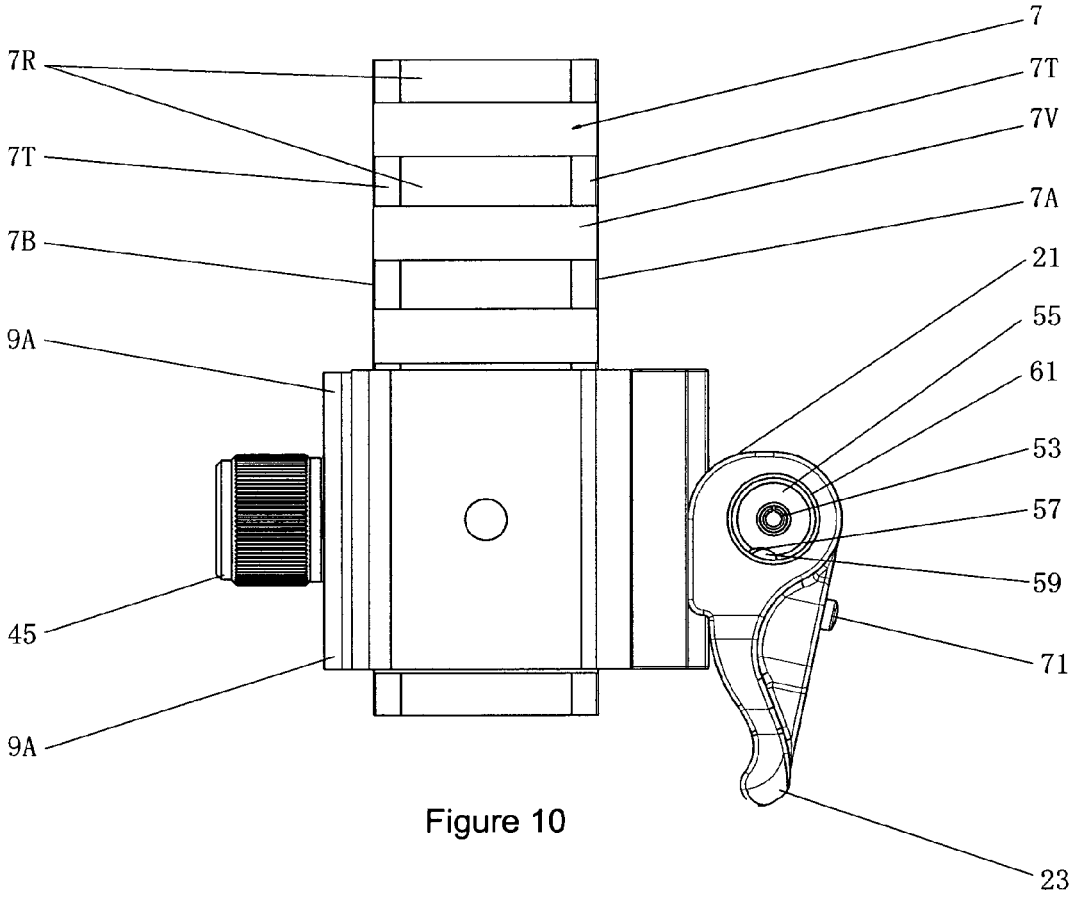
FIG. 10 is a top view of the mounting attachment in a closed position mounted to a firearm rail.

With reference to the Figures, there is provided pursuant to the present invention a firearm mounting attachment (generally referenced as 1) which readily detaches, attaches and locks the attachment 1 to a rifle forearm mount such as an AR-15 style forearm rail 7 or adaptable to mount onto other firearms F. The attachment 1 comprises a main body 3 equipped with a support bed 5 channeled to receive the rack 7 or other suitable mount therewithin, said body 3 including a pair of jaw members 9A & 9B each equipped with an inwardly projecting jaw ends 11 (not necessarily essential) for engagement onto the mount (e.g. rail 7) and particularly for engagement onto the triangular ridges or flanged margin 7T projecting outwardly along the upper margins of both the sidewalls of the rail 7 (e.g. see FIGS. 2-7 and 16-17) with at least one of the pair of jaw members 9A and/or 9B being moveably or pivotable mounted to the main body 3 to permit a longitudinal closure movement of the jaw members 9A & 9B. As may be observed from FIGS. 5, 7 and 16-17, the upper rail 7 sidewall margin provides a projecting rim or flanged section 7T which nestles onto the mating triangular recess of stationary jaw 9B and the ramped 9A jaw section 9S provided by supportive body 3 with movable jaw 9A overlapping and clamping onto the rail section 7T opposite from jaw 9B when placed in the closed position. The device 1 may appropriately include a supportive bed 5 channeled with a longitudinally extending bed 5 sized to receive a forearm rail 7 as typically mounted to an automatic rifle AR of the AR-15 style. The supportive body or member 3 may suitably be equipped with at least one biasing unit 29 (e.g. a compression spring 29A & 29B) for biasing the movable or pivotal mounted jaw members 9A apart to an open position upon release of a compressive force exerted thereupon. Alternatively the biasing unit 29 may be appropriately compress and allow closure of jaw section 11 of jaw 9A upon application of the compressive force thereto. With particular reference to the attachment 1 of FIGS. 2, 9-10 and 21, the bottom forearm rail 7 is shown as being firmly or securely gripped between jaws 9A & 9B at a locked and closed position. A cross-sectional view of FIGS. 2 and 10 shows the levered cam 20 in the closed and latched position. The depicted embodiments depict pivotal mounted jaw section 11A of jaw 9A with jaw bed 9S being depicted as a stationery jaw section 9S. However, jaw section 9S of jaw 9A may be an integral piece so that both jaw sections 9S & 11A of jaw 9A would move together as actuating rod 19 moves. Jaws 9B is depicted as comprising to stationary sections namely ramped section 7S and flanged section 11B which are designed to mate onto rail rib 7T.

Figure 16:
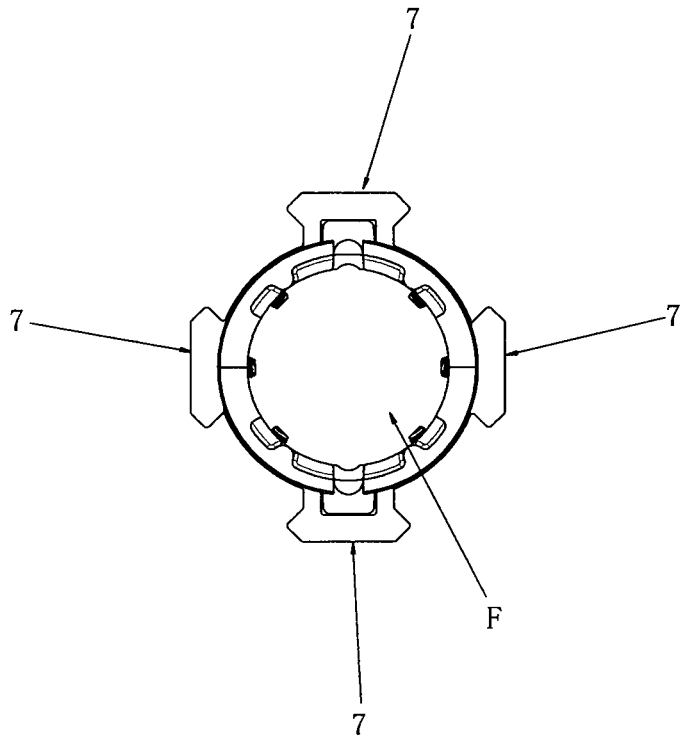
FIG. 16 depicts an end view of a typical firearm rail for mounting onto a AR-15 firearm forearm as depicted in FIG. 15.
Figure 17:
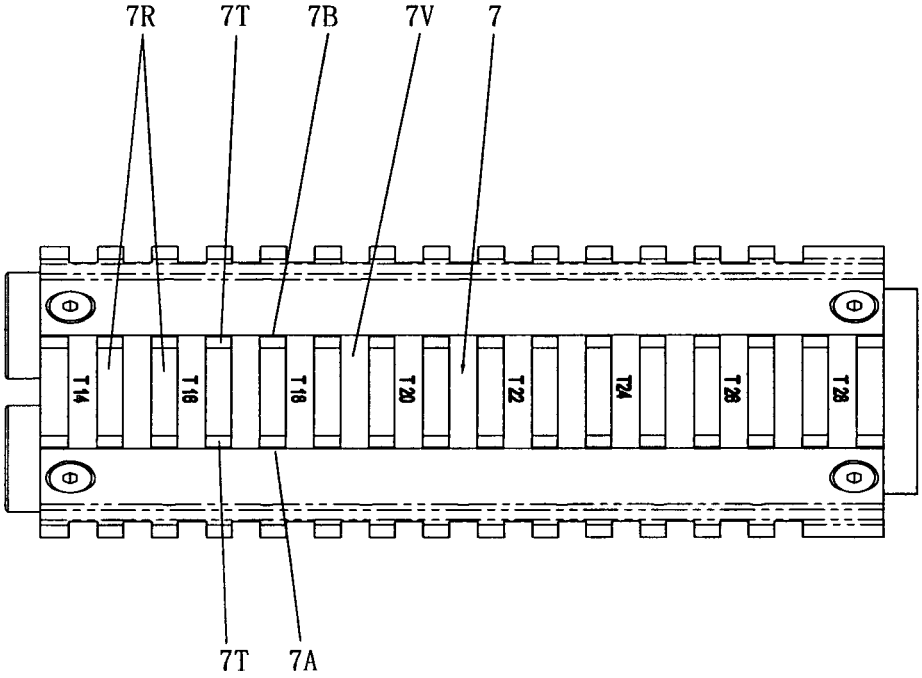
FIG. 17 is another view of FIG. 16.
Figure 18:
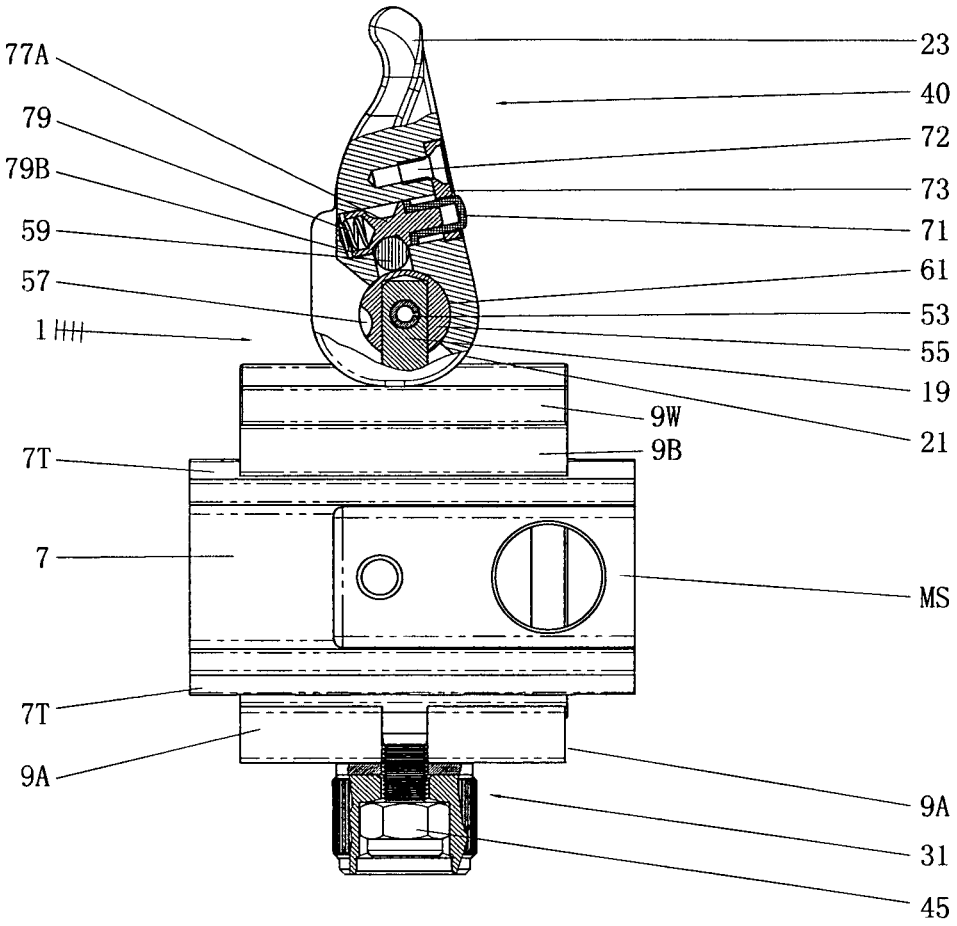
FIG. 18 is a cross-sectional top view image of the locking system used to lock and unlock the attachment device to a firearm rail with the levered cam being positioned in a fully opened position.

The attachment device 1 of this invention is generally applicable to any rifle F equipped with accessory rail 7 or may be modified to mate onto any other type of mounting site 7 upon which the gripping jaws 9A & 9B may be securely wedged therebetween. The depicted attachment 1 is particularly adapted to attaching the attachment 1 to rails 7 of an AR-15 type of rifle F. These rails 7 are typically mounted above, below and onto the sides of the rifle forearm. Although the rails 7 derived from different manufacturing sources may differ structurally somewhat, the rails 7 still have in common sufficient structural similarities which are adaptable to attachment 1. As illustrated by FIGS. 16-17 most rails 7 mountable or mounted to AR-15 style rifles F have mounts equipped to mount to a forearm with the mounting site surface having pronounced cross-wise ribs 7R separated by valleys 7V of a right angled configuration nestled between the ribs 7R. The rails 7 commonly have a longitudinally extending overhanging rib or lip 7T which typically serves as an attachment mount 7. FIGS. 3-7, 10-11 and 15-16 depict a typical rail 7 mountable to AR-15 type firearms.

Figure 3:
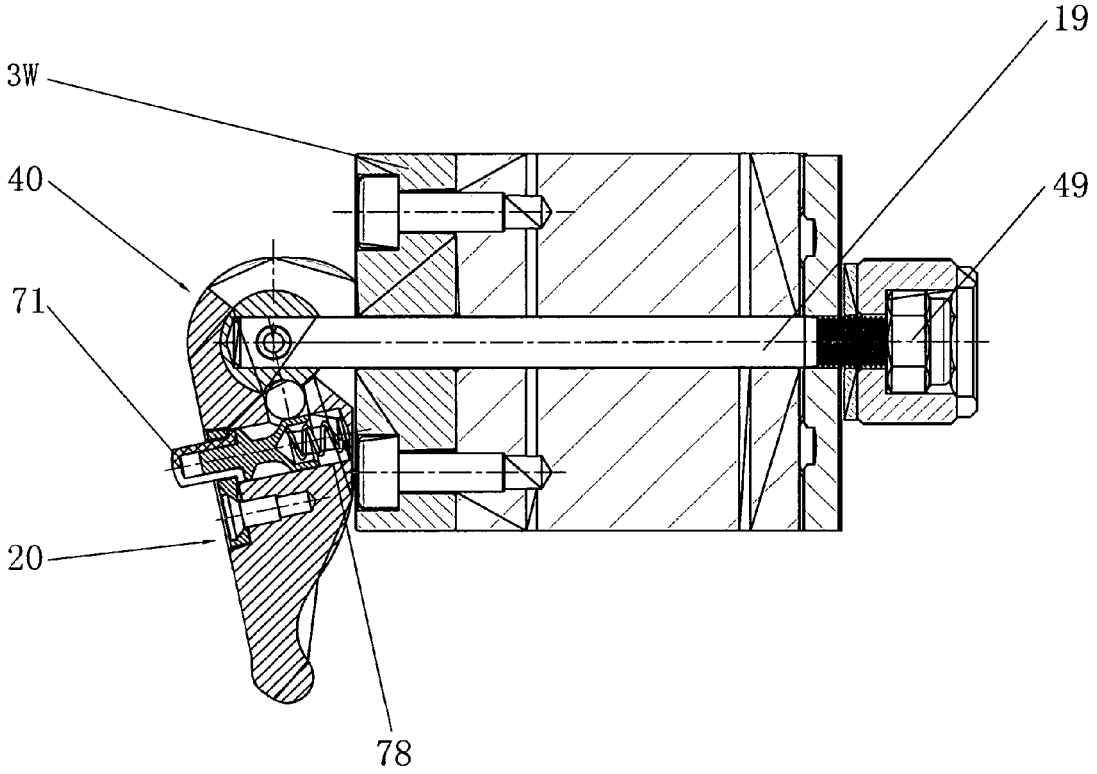
FIG. 3 is a cross-sectional view of FIG. 2.
Figure 4:
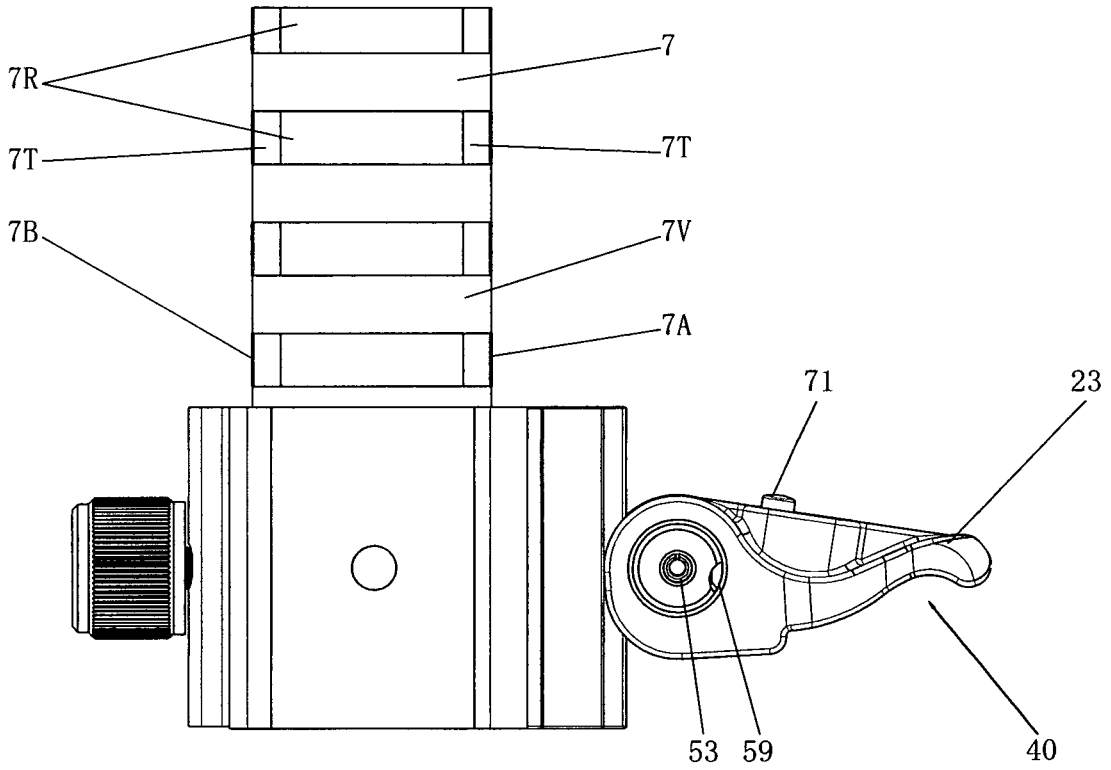
FIG. 4 is a top view of the mounting attachment of this invention positioned in an open position for mounting onto the depicted firearm rail.
Figure 5:
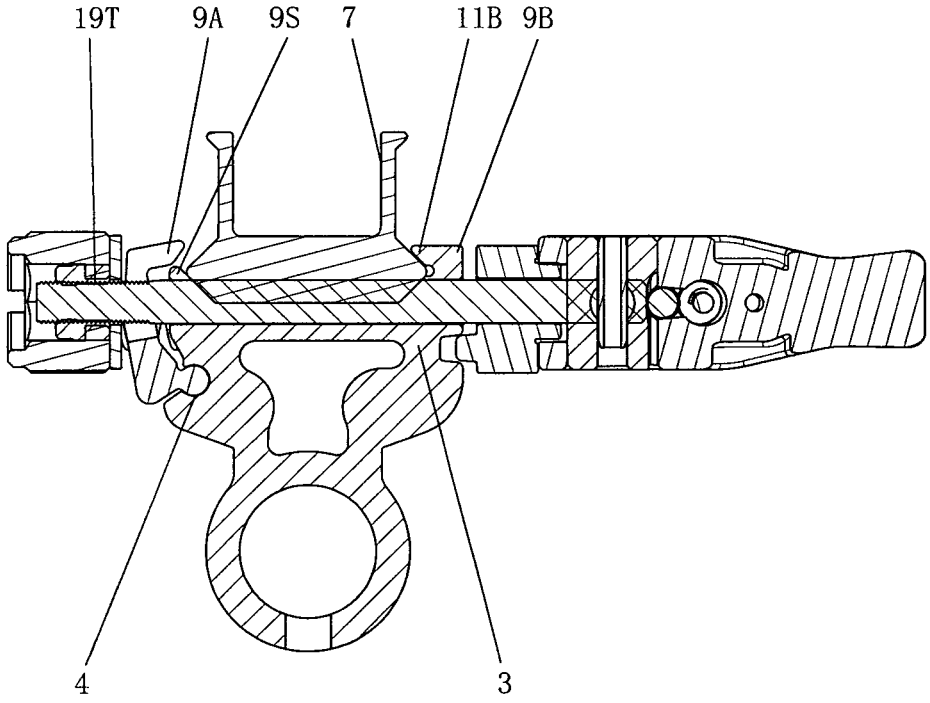
FIG. 5 is a cross-sectional view of FIG. 4.
Figure 6:
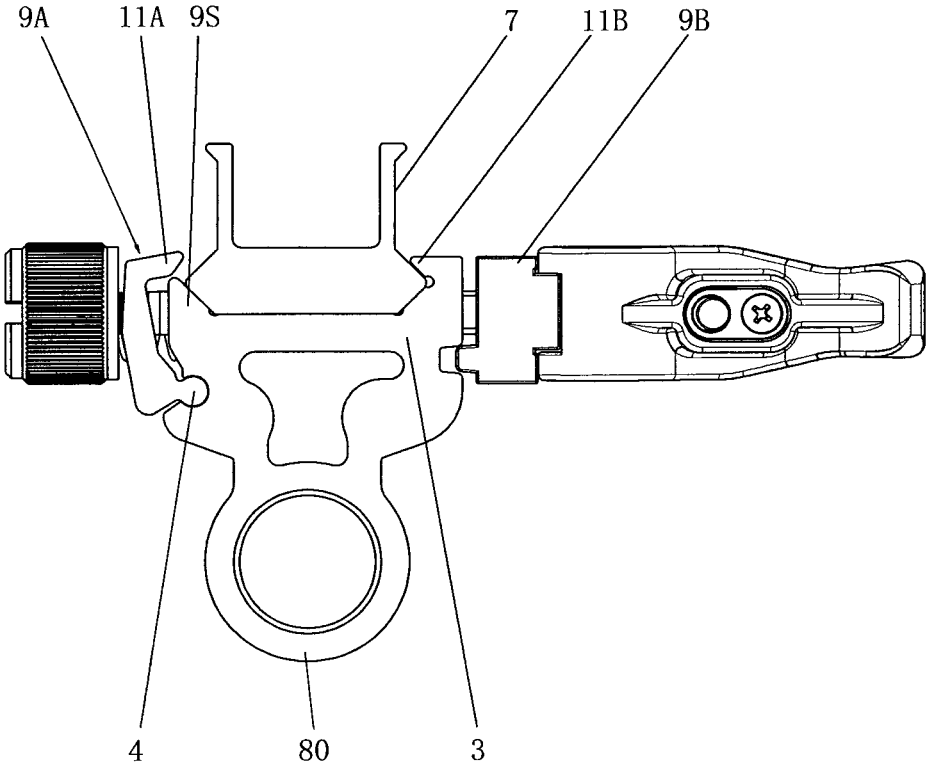
FIG. 6 is a rear view of the attachment depicted in FIG. 4.
Figure 7:
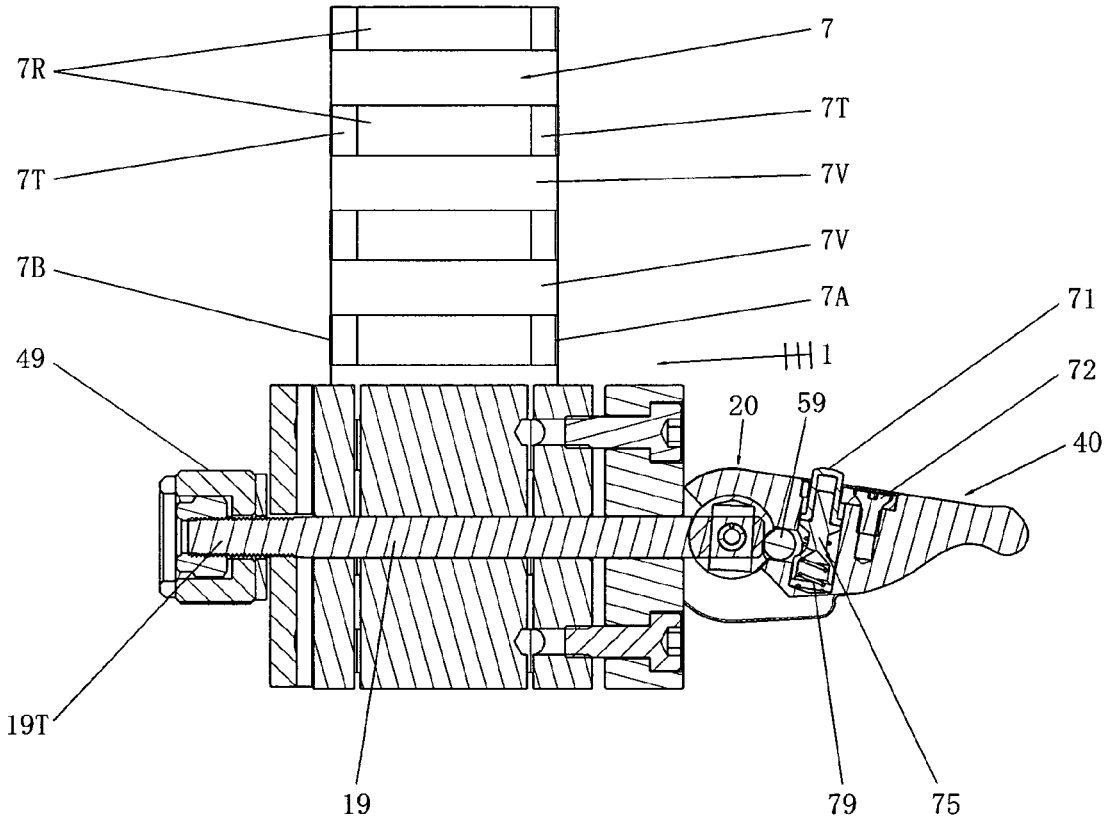
FIG. 7 is a cross-sectional view of FIG. 4.
Figure 8:
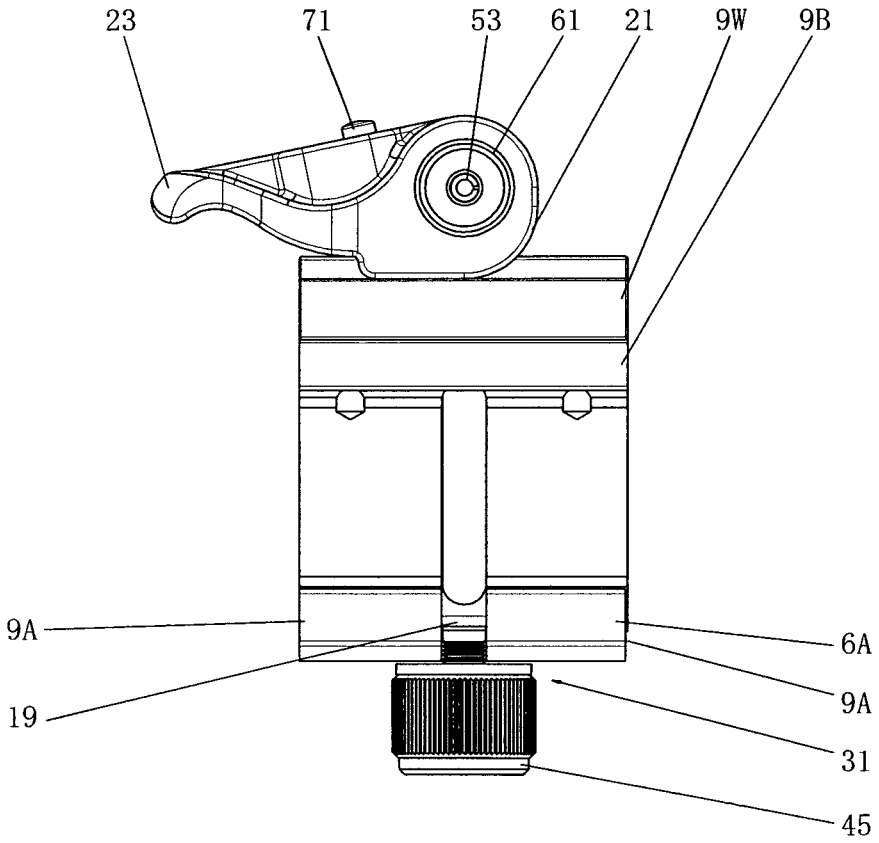
FIG. 8 is a top view of the attachment shown in FIG. 4 positioned in the closed firearm rail gripping position.
Figure 9:
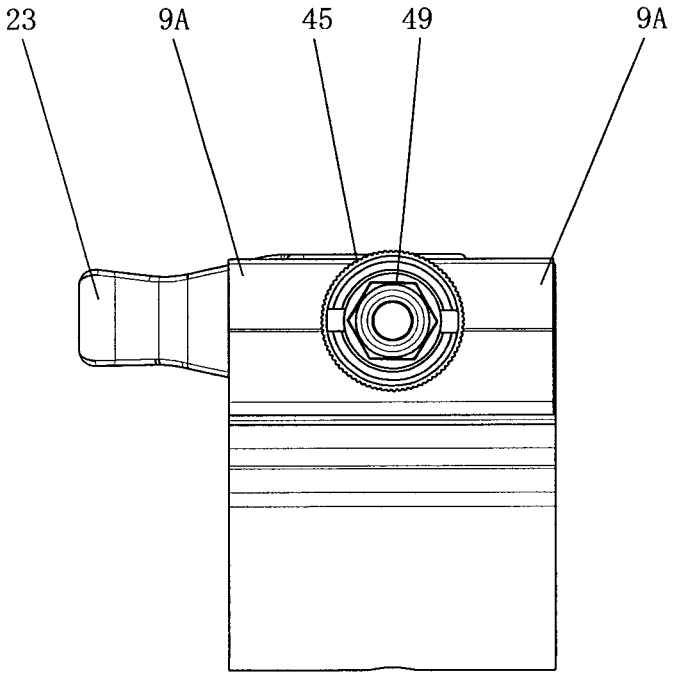
FIG. 9 is a side view of FIG. 8.
Figure 11:
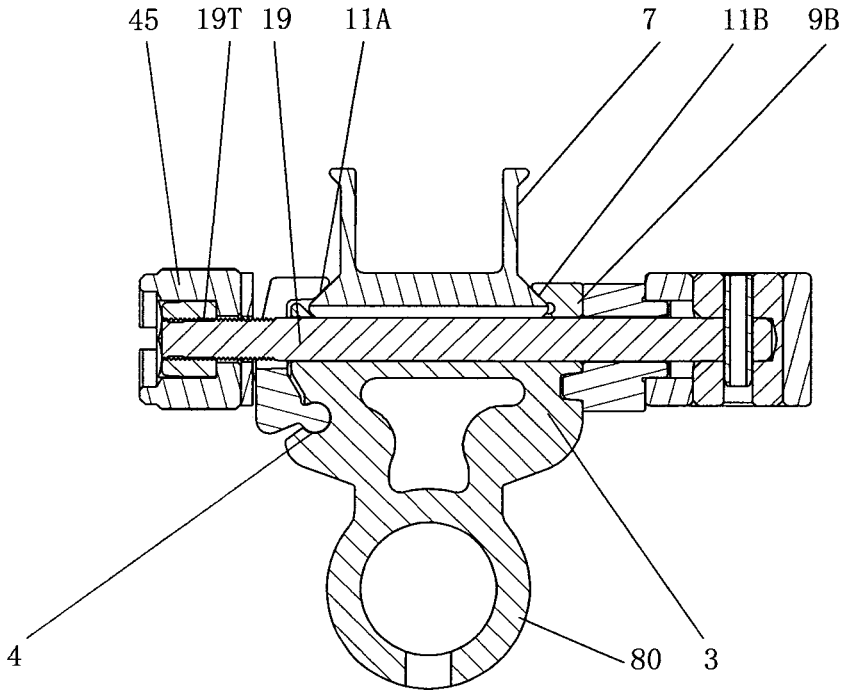
FIG. 11 is a cross-sectional view of FIG. 10.
Figure 12:
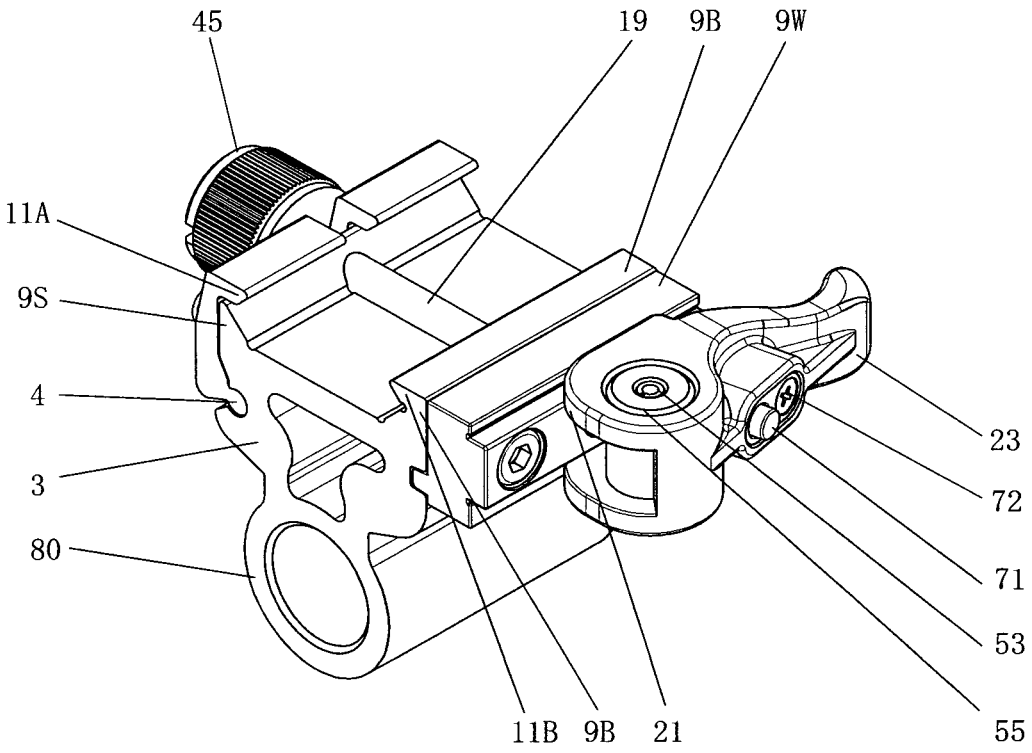
FIG. 12 is an isometric top view of the mounting attachment of this invention positioned in the closed and locked position.
Figure 13:
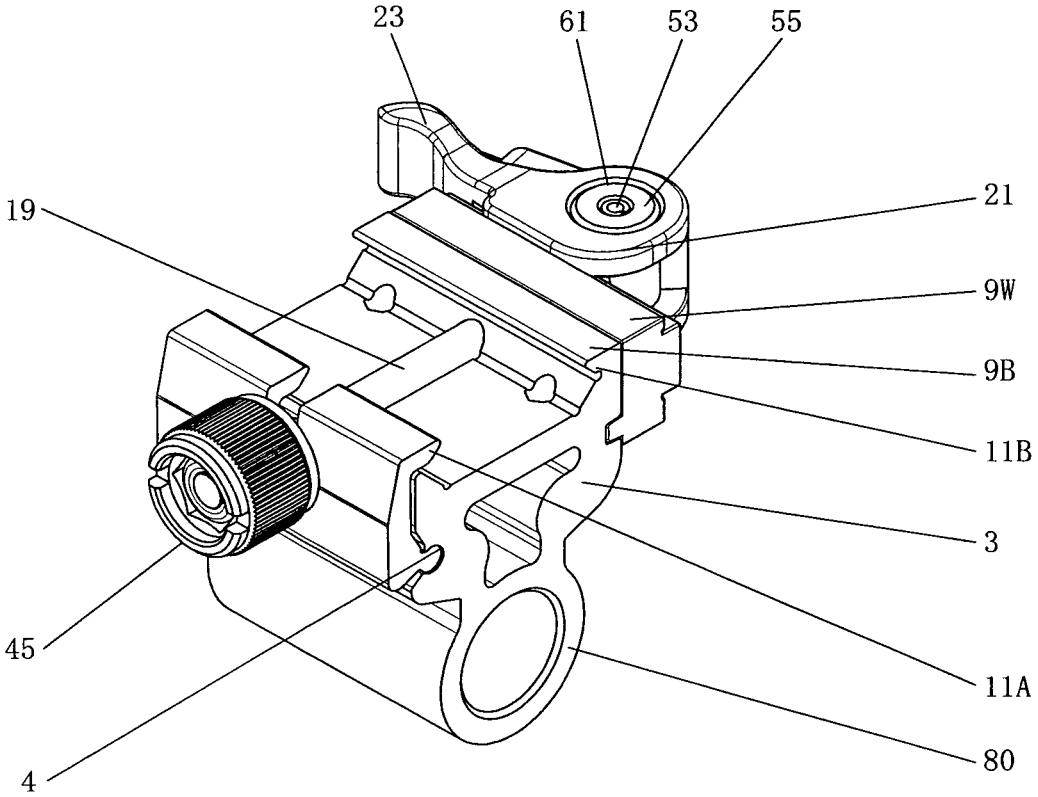
FIG. 13 is an opposite side view of FIG. 12.
Figure 14:
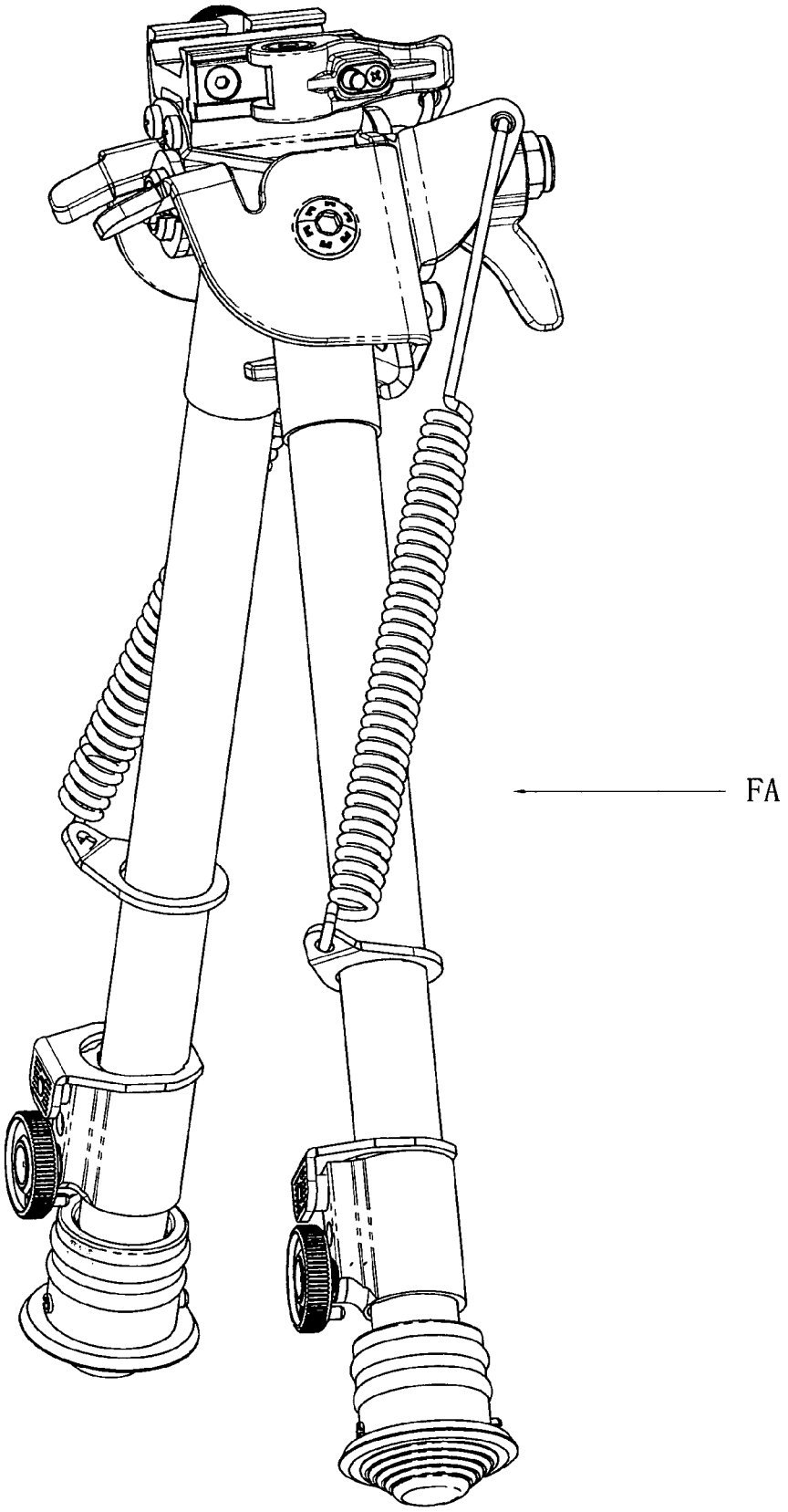
FIG. 14 depicts the assembled attachment device shown in FIG. 1.
Figure 15:
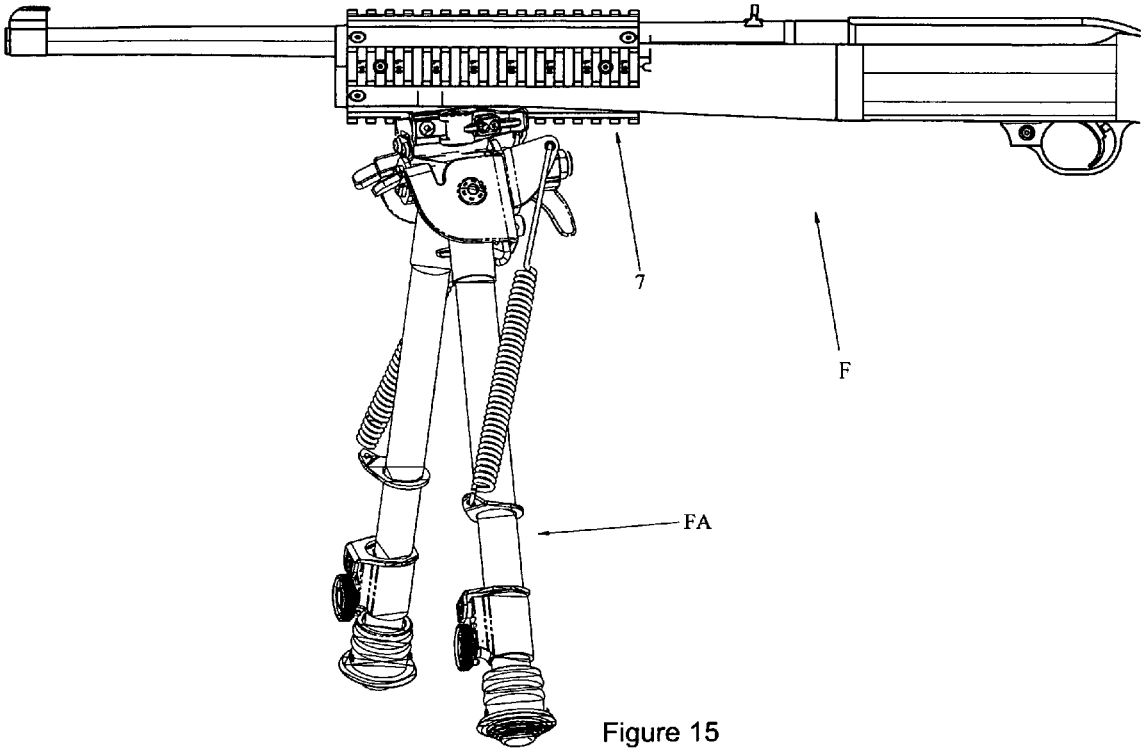
FIG. 15 depicts the attachment device shown in FIG. 13 equipped with adjustable bipods attached to an AR-15 firearm.

An actuating or drive rod 19 operationally connected to the moveable or pivotally mounted jaw section 11A serves to pull jaw section 11A onto rail lip 7T and to permit a closure of jaws 9A & 9B upon rail 7 in a closed position as depicted by the FIGS. 3 and 10-11. A levered cam 20 equipped with a cam 21 which rides on wear plate 3W and a lever 23 operationally connected to the actuating rod 19 serves upon rotational movement of cam 21 to draw the jaw section 11A onto rail 7 which in turn seats jaw 9A & 9B onto rail 7 in a closed and locked position with jaw section 11A overlapping or clamping onto the top side of rail rim 7T. The underneath portion of rail section of rim 7T engages upon a fixed outwardly slanted section 9S of jaws 9A & 9B of bed 5 which mate onto the underneath portion of rail rim 7T. An opposite rotational movement of cam 21 in conjunction with an unlocking of a locking system 40 serves to release jaw section 9A to an open position. The locking may be effectuated by an off-centering position of cam 21 or by including a locking stop which maintains the levered cam 20 in a locked position. Accordingly, the attachment 1 includes a lock system 40 for locking the pair of jaw members 9A & 9B (particularly movable jaw section 11A) in the locked and closed position and a lock release for unlocking and releasing either jaw section 11A or the pair of jaw members 9A & 9B to an open position which may be effectuated by the outwardly biasing force exerted by the biasing unit 29 (i.e. compression springs 29A & 29B) upon pivotally mounted jaw section 11A.

The depicted attachment 1 includes a pair of jaws 9A & 9B depicted as having terminal flanged contacting ends 11A & 11B adapted to seat a top of railing 7T and underneath jaw sections 9S of jaws 9A & 9B specifically designed so as to mate onto the topside rim 7T of rail 7 which extend lengthwise along the top margin of the sidewalls of rail 7. It is necessary for at least one of the jaws (e.g. 9A and/or 9B) or jaw section (e.g. 11A) to provide the necessary closure upon rail 7 by a closure movement onto a mounting rail 7. The Figures depict at least one movable jaw section 11A (serves as a clamping section) amongst a paired jaws 9A & 9B. Movable jaw section 11A (i.e. upper jaw part) is pivotally hinged by hinging mechanism of a longitudinal socket 4 molded into the structure of supportive body 3 and a longitudinal extending articulating hinged section 9J. The pivotal hinging mechanism of 4 & 9J allows hinged jaw section 11A to be drawn or clamped onto rail rib 7T by actuating rod 19 which thereby firmly seats both of the contacting jaw ends 11A & 11B of jaws 9A & 9B and the ramped section 7S onto rail 7 to securely mount and securely attach the attachment 1 to rail 7. It will be observed that jaws 9A & 9B are positioned upon the body 3 so that the jaw ends 11A & 11B upon closure of jaw section 11A will accordingly positionally seat onto the top side of rim 7T of rail 7. As also evident from the Figures, one of the jaw sections 11B is pivotally mounted whereas the other jaw end 9B forms a V-shaped recess is permanently affixed, molded or machined onto the main supportive body 3.

As may also be observed from the Figures, moveable jaw 11A may be operationally drawn onto rail 7 by an actuating rod 19 operationally connected to a levered cam (generally referenced as 20) which when activated by rotational movement of cammed lever 20 draws or clamps jaw 11B onto rail 7 onto a closed position to anchor the forearm rail 7 securely within jaws 9A & 9B of the attachment device 1. Conversely in the absence of a compressive force exerted by the cam 21 onto actuating rod 19, the biasing compression springs 29A & 29B will open jaws section 11B so as to allow the attachment 1 to be removed from rail 7 or positioned anywhere along rail 7. As mentioned previously, adjustability to fit diverse mounts 7 may effectuated by making jaw 9A completely movable along a horizontal axis (i.e. all of jaw 9A) using threaded rod end 19T and nut 49 to adjust to the mounting site 7 size. Similarly jaw 9B and/or jaw section 11B may embody the movable components with 9A & 11A being fixed with actuating rod 19 conversely using a pushing action to effectuate a jaw 9A & 9B closure.

With particular reference to the Figures, the body 3 may be suitably provided with two actuating rod receiving apertures 23A & 23B positioned so as to allow actuating rod 19 to move freely within body 3 and between jaws 9A & 9B to provide the necessary moving motion in response to the rotational movement levered cam 20. The distal end of the actuating rod 19 which is oppositely positioned from the cam operated lever 20 includes a rod stop (generally referenced as 31) which when the rod 19 is operationally drawn towards levered cam 20 serves as a pulling stop 31 which upon engagement against moveable jaw section 11A pulls pivotally mounted jaw section 11A onto the upper rim portion 7T of rail 7. This tightly biases jaws section 11A as well as jaws 9A & 9B against rail 7 when jaw section 11A is drawn to a closed position. The rod stop 31 may appropriately be constructed of cylindrical tension adjusting knob 45 with a bolt receiving bore 43, compression washers 41 at each end of knob 45 and a threaded tension nut 49 to adjust tension upon the threaded bolt end 19T of activating rod 19. Rod stop (generally enumerated as 31) serves as a pulling stop when jaw section 11A is closed while compression springs 29A & 29B push jaw section 11A to a stopped opening position.

The depicted attachment 1 includes a tension adjusting knob 45 of a sealed cylindrical shape with a center lengthwise bore 43 to permit passage therethrough of the threaded end 19T of the actuating rod 19. The circumference of adjusting knob 45 includes a recessed socket sized to mate onto tension nut 49. The circumferential surface of knob 45 includes a longitudinally notched or serrated ridges which allows the operator to readily adjust the desired tension by thumbing or fingering the adjusting knob 45 to the desired tension for rod 19. The tension adjusting knob 45 may be made from a host of materials (e.g. hard rubber, plastics, metals, etc.). If desired a metal socket insert of a durable metal may be used should body of knob 45 be constructed of a material prone to wear.

The actuating rod 19 opposite from its connection to rod stop 31 is operatively connected to levered cam 20 by activating rod pin 53. As cam 21 operationally rotates clockwise or counter-clockwise about its rotational axis, the following actuating rod 19 pinned to cam 21 effectively serves to place jaw section 11A and thus jaws 9A & 9B in a closed clamping or an open position. A clockwise rotational movement of cam 21 places jaw section 11A and jaws 9A & 9B in an open position while an opposite rotation closes the jaw section 11A onto rail rim 7T to seat rail 7 within jaws 9A & 9B. The sidewall of body 3 on the same side as the pivotally mounted jaw 9A may be appropriately provided with other types of an outwardly biasing member 29 (shown as springs 29A & 29B) which when the actuating rod 19 becomes positioned in the open position or non-compressive position will serve to bias movable jaw section 11A to the open position. With reference to the Figures, it may be observed that one or more springs 29 or any other suitable biasing member 29 may be effectively used for this purpose. As may be further observed, the body 3 may be provided with any type of suitable spring retaining member 29S which serves to retain the biasing member 29 in an operable positioning for moving jaw section 11A or jaw 9A away from jaw 9B or rail 7. The jaw 9 biasing member 29 need not necessarily be a compression spring 29 as depicted by the Figures since other biasing members 29 such as leaf springs, hydraulics, etc. may also be used. The accompanying Figures illustrate the use of two retaining spring apertures (not shown) to partially confine and house the two compression springs 29A & 29B which forces the jaw section 11A away from rail rim 7T when the levered cam 20 is at the open position while springs 29A & 29B compress towards the spring housing when levered cam 20 is moved to the closed and locking position by the actuating rod 19.

Figure 1:
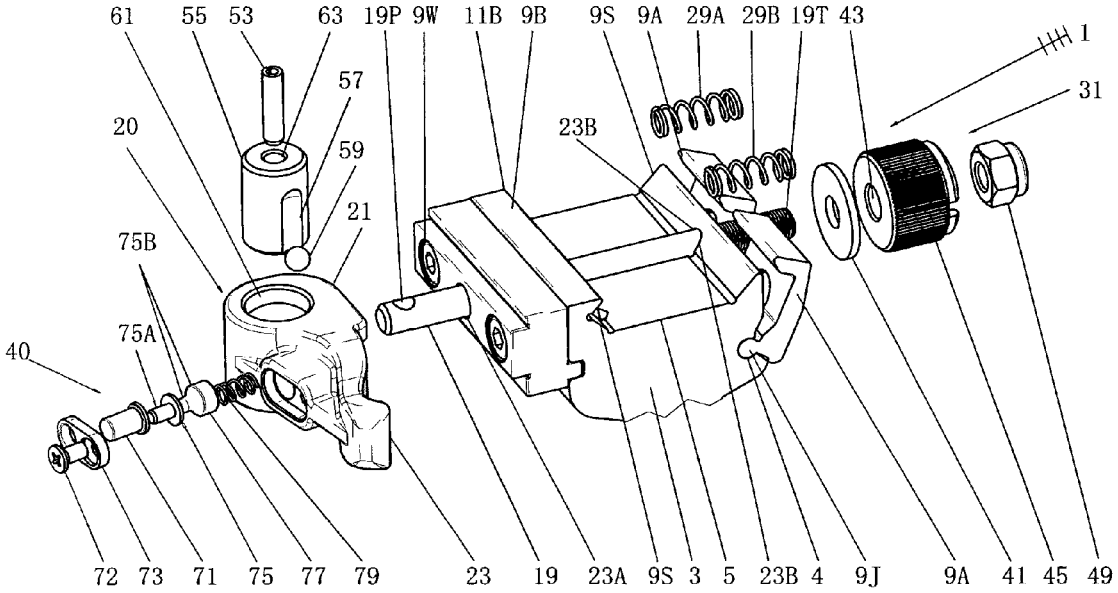
FIG. 1 depicts an exploded view of the various component parts of the attachment device of this invention.

A detailed exploded view of the various component parts of the device is depicted by the disassembled exploded attachment view of FIG. 1. The actuating rod 19 serves to operatively connect the levered cam 20 to pivotally mounted jaw section 11A. As may be also observed the supportive body 3 includes a body bed 5 for cradling onto forearm mounting site such as the depicted rail 7. The body 3 includes a fixed jaw section 9B and a pivotally mounted or movable jaw section 11A of jaw 9A disposed at an opposite bed side 5 from the fixed jaw 9B. The activating rod 19 is housed within the body 3 by sidewall apertures 23A & 23B so as to allow reciprocal movement of rod 19 therein in response to linear movement imparted by the rotational movement initiated by levered cam 20. The activating rod 19 distal to its connection to levered cam 20 may be threaded with threads 19T. The activating rod 19 is of sufficient length to serve as a drive unit 19 to pull or clamp jaws 9A & 9B depicted a pivotally mounted jaw section 11A to rail 7 or any other suitable forearm mounting site 7. The distal end of the activating rod 19 desirably includes the resilient adjustable compression sleeve 41 (e.g. a stiff rubber sleeve). The amount of tension applied against pulling the activating rod 19 to a closed position and an opening position may be effectuated either by tightening tension nut 49 to compress resilient adjuster 41 and apply more tension or by loosening tension nut 49 to reduce tension or provide greater jaw section 11A clearance. Similarly providing jaw 9A as a completely movable jaw section 11A allows threaded actuating rod 19T be used to accommodate any mounting site 7 simply by adjusting nut 49 to fit the mounting site 7. The jaw 9B may be integral casted part of the body 3 which may include a wear side plate 3W mounted to the casted body 3 next to a levered cam 20 to provide better resistance against wear caused levered cam 20. If desired providing with a threaded bore (not shown) and threading movable jaws 9A & 9B with opposite threading thereto. Jaws 9A & 9B would both serve as movable jaws.

The pivotally mounted jaw section 11A as depicted in FIGS. 4-7 and 17 and the unassembled FIG. 1 view depict an open jaws 9A & 9B position whereas FIGS. 2-3, 10-13 and 21 show the pivotal mounted jaw section 11A in the closed and locked position. It may also be observed, in the absence of pressure exerted upon jaws section 11A by the activating rod 19 effectuated by rotating levered cam 20 compression springs 29 seated within body 3 (i.e. upon an opening of jaw 9A) serve to bias pivotally mounted jaw section 11A to the open position. It may be further observed from Figures that the movable jaw section 11A is hinged to the body 3 by a longitudinally extending socket 4 onto which a longitudinal extending joint 9J provides the joint or hinging of jaw section 11A thereto. Other hinging mechanisms which permit jaw 9A or jaw section 11A to pivot about a hinging axis or otherwise move may also be used for this purpose.

As may also be further observed from the Figures, the body member 3 positioned at the proximate or cam levered 20 side includes a sidewall wear plate 3W screwed or otherwise affixed onto the body base 3 to protect the body member 3 against wear caused by repetitive rotational movement of levered cam 20. It may be further observed that the proximate end portion of the actuating rod 19 includes an activating rod pin aperture 19P serving to pin or connect activating rod 19 onto the movements of the latching and unlatching system (in general designated as 40) which provides the inertia for jaw movement (i.e. opening and closing) as well as the latching and unlatching system and thereby restrict or allow movement of the levered cam 20.

It may also be observed from rail FIGS. 16-17, that activating pin or rod 19 is positioned so as to pass through a repetitive series of boxed valleys 7V site nestled between adjacently positioned rail ribs 7R. The activating rod 19 is positioned and provided with sufficient clearance so as to move unobstructed within a selected rib valley 7V for mounting the attachment 1. As may be further observed from the Figures, the levered cam 20 becomes displaced at a greater off-set position or distance from body wear plate 3W and jaw 9A when cam lever 23 is placed in or pulled out to a closed locked position. When using the attachment 1, unlocking the jaws 9A & 9B (namely jaw section 11A) may be simply accomplished by unlatching the lock and flipping cam lever 23 to the open position. The quick locking and unlocking system 40 comprises a single levered stage action wherein a lock release may be effectively activated by pushing a release button 71 which depresses release spring 79 which allows a locking ball 59 to fall onto a ball carrier shaft section 75A displacing ball 59 from its channeled stop 57 and its shaft section stop 75B. The depicted locking mechanism 40 is positioned as a right side mounted locking and rod actuating system in which a clockwise cam 21 movement opens and a counterclockwise movement closes jaw 9B. If the locking system 40 was placed on the left side of bushing 55 the rotational movement would reverse the opening and closure. Unlike current rail locking systems, the rail 7 may accordingly be readily unlatched from the rail 7 or securely latched to the rail 7 simply by either a clockwise or counter clockwise thumbing or finger action upon lever 23 coupled with a depressing of unlatching or release button 71. The prior art defects which require holding and tightening set screws or other such cumbersome techniques with both hands are thereby alleviated by the rapid attach and detach embodiments of this invention.

Movement and locking of the jaws 9A & 9B in a closed locked position and an open position is accomplished by a unique levered cam 20 especially equipped for this purpose. With particular reference to the exploded view of FIG. 1, it will be observed that the proximate end actuating rod includes a pin aperture 19P which seats by rod 19 thereto onto actuating rod pin 53. A cam bushing 55 includes a ball receiving groove 57 slot, channel, hole or either suitable recess which locks levered cam 20 upon placement of locking ball 59 within groove 57. Cam bushing 55 includes pin bore 63 which upon the pinning with the actuating rod pin 53 thereto provides a hub 61 for axle movement of rod 19. Levered cam 20 thus includes an offset hub 61 which allows cam 21 of the levered cam 20 to rotate at a 90 degree about hub 61 by the rotational movement initiated through lever 23.

Bushing 55 may be compression fitted to hub 61 or actuating pin 53 in the form of a tension pin to seat bushing 55 onto hub 61. If a tension pin 53 is used, then pin aperture 19P should be sized to allow the tension pin 53 to freely rotate therewithin. Bushing 55 may alternatively be constructed of a host of materials (e.g. metal, plastics, hard rubber, etc.) suitable for use as a compression bushing 55 fit. Bushing 55 should be durable so as to remain durable for its intended use while also lending itself to be compression fit within its bushing housing of levered cam 20.

The unlatching and latching unit (generally designated as 40) includes a release button 71 retained or secured to levered cam 20 by retaining plate 73, an unlocking and locking shaft 75, spring plate 77, release spring 79 and an unlatching and latching unit housing 78 housed within levered cam 20 which houses the unlatching unit mechanism 40. Housing unit 78 tangentially channels onto hub 61 of bushing 55 with a sufficient housing or clearance therebetween to permit ball 59 to seat onto ball receiving channel 57 when levered cam 20 is placed in the closed jaw position. With particular reference to the unlocking and locking shaft (e.g. see 75), it will be observed that shaft 75 is flighted so as to include an unlatching flight 75A which unseats ball 59 at a depressed elevational level or at a ball carrying flight so as allow movement of levered cam 20 to move freely about the circumferential surface of bushing 55 and an elevated shaft flight 75B which elevates and seats the ball 59 within the recessed ball receiving channel 57 of bushing 55 while ball 59 is then seated within the recessed ball receiving channel 57 whereby levered cam 20 is locked from any further movement.

Figure 19:
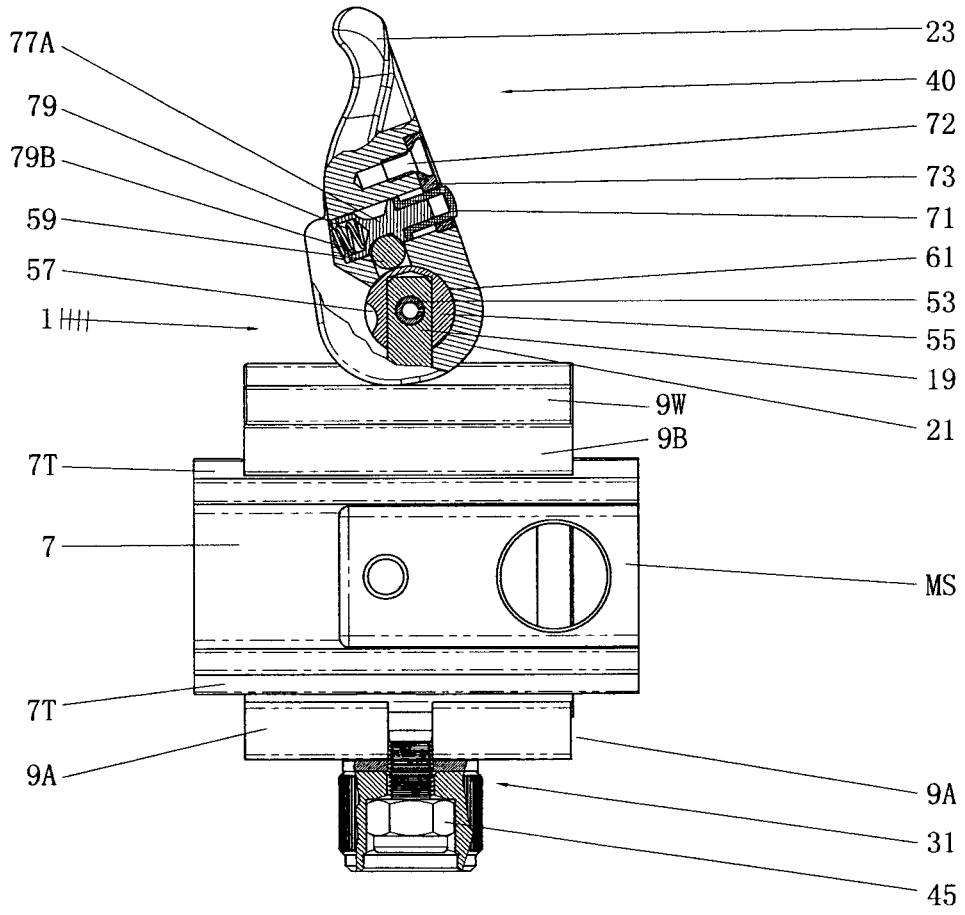
FIG. 19 depicts the cross-sectional image of FIG. 17 with the levered cam commencing rotational movement towards a locking position.
Figure 20:
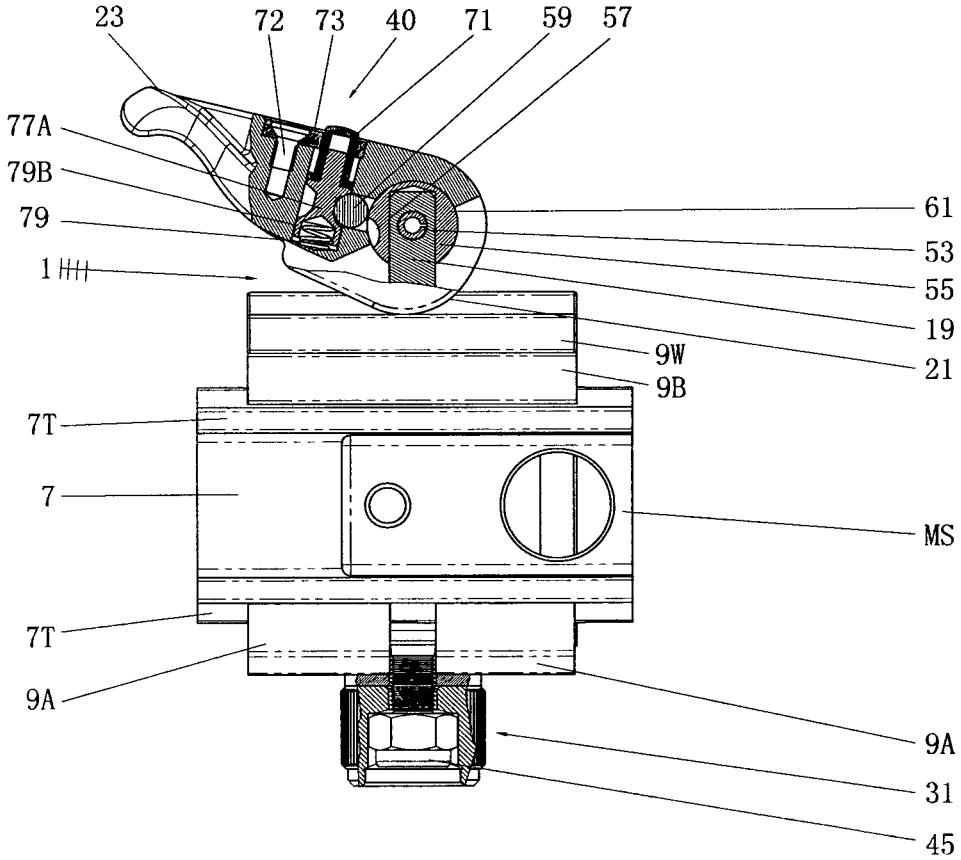
FIG. 20 depicts the locking system on the verge of rotationally being placed in the locking position.
Figure 21:
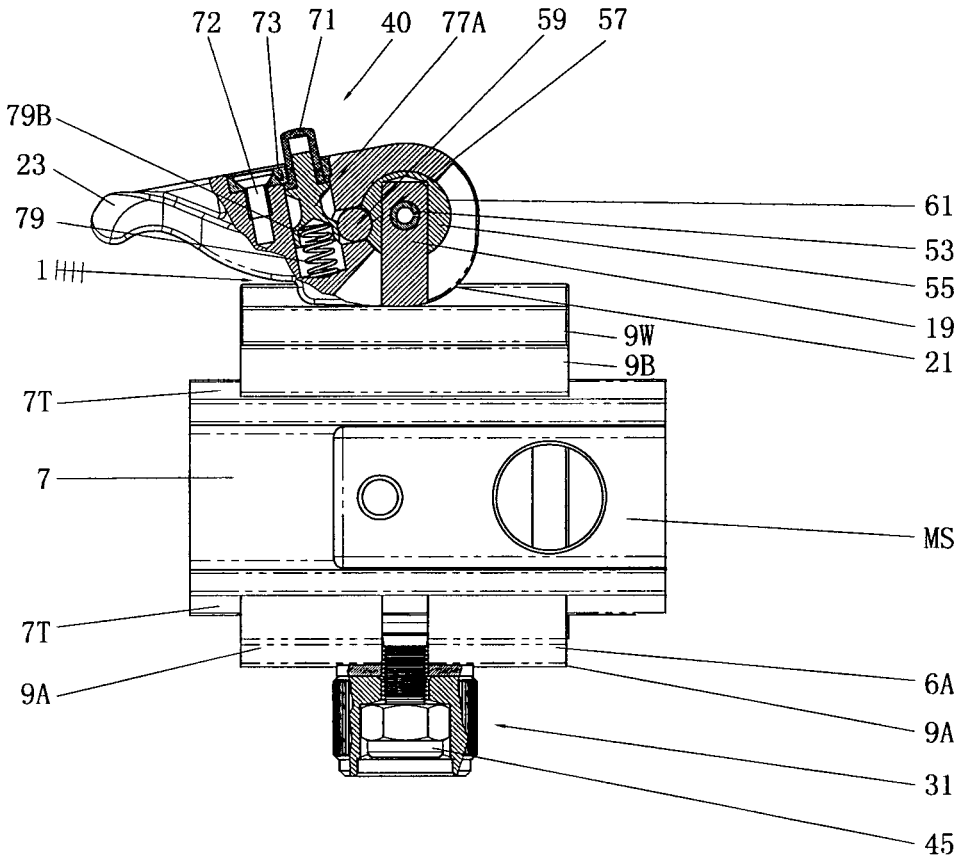
FIG. 21 depicts the locking system depicted by FIGS. 17-19 rotationally positioned at the locking position with the jaws being firmly gripping the firearm rail in the locked position.

FIGS. 2-3, 8-13 and 21 depict a locking system for locking the attachment 1 in a closed position. The depicted locking system relies upon a locking and unlocking assembly (generally designated as 40) which includes a ball receiving channel 57 and a ball 59. As may be observed particularly by the Figures, jaw section 11A is concurrently pulled towards rail rib 9T as ball 59 counterrotationally rotates circumferentially about the axle providing by bushing 55 until it is stopped or pinned at its stationary position by ball receiving channel 57. The levered cam 20 structure provides the hub 61 upon which levered cam 20 rotates within a 90 degree arc in response to a corresponding movement lever 23 provided that ball 59 is clear or disengaged from channel 57. As previously mentioned the depicted cam bushing 55 is provided with a ball receiving grooved slot or channel etc. 57 for accepting the ball 59. When the ball 59 and ball receiving aperture 57 are placed in rotational alignment with one another, then levered cam 20 is locked. FIGS. 19-21 depict sequential movement of ball 59 as the levered cam 20 is counter-rotated through a 90 degree arc beginning at the open jaw position and ending with the ball 59 being ultimately seated in the grooved channel 57 at the locked position. As may be observed, the locking shaft 75 includes a reduced diameter flight section 75A (a ball carrying section) and an elevated flight section 75B of an increased shaft diameter, the former of which serves to rotationally carry the ball 59 about the bushing 55 with the latter elevated flight 75B serving to push or force the ball 59 onto the recessed ball receiving channel 57 of bushing 55 to lock the levered cam 20 and jaw section 11A as well as jaws 9A & 9B in the closed and locked position.

The locking and unlocking shaft section 75A & 75B are housed within housing unit 78 of the levered cam 20 body and positioned so as to be in operational contact with the ball 59. A button cover plate 73 and a release button 71 in combination with the button cover plate 77 operationally retains the locking and unlocking system 40 within housing 78. The locking shaft unit 75 includes a reduced or smaller diameter section 75A which retains the ball 59 in a carrying position as the levered cam 20 rotationally moves through the unlocked stages of movement. The distal end of shaft 75 includes the locking shaft section 75B which has a substantially larger cross-sectional shaft size or diameter than shaft section 75A. The locking shaft section 75B upon rotationally passing of the ball 59 onto receiving aperture or channel 57 (while compressing the ball biasing member 79 shown as a compression spring) forces the ball 59 into slot or aperture 57 to lock the activating rod 19 and levered am 20 in the closed and locked position. By depression of stop release button 71, shafts 75A & 75B are forced inwardly by compressing the compression release spring 79 sufficiently to make available the ball carrying shaft flight 75A and thereby effectuate removal of ball 59 from its channeled stop 57 by removing shaft section 75B therefrom and thereby allowing for movement of levered cam 20.

If desired, the shaft flights 75A & 75B may include a concave or curved structure to assist placement and removal of the ball 59 from the channeled ball receiving aperture 57. It may be noted again that the terminating or distal end of the unlocking and locking shaft assembly 40 engages onto a biasing member 79 depicted in the form of a compression spring 79 which forces the shaft section 75B of the locking shaft assembly 40 to the locked position to enable seating of ball 59 within the channeled ball receiving indenture 57. The compression spring 79 retains the shaft section 75B of assembly 40 in this locking position until a compressive force exerted upon release button 71 displaces the larger diameter shaft section 75B with the smaller shaft section 75A which allows movement of the ball 59 out of its locking position. Unlocking the locked ball 59 accordingly entails pushing unlocking button 71 to compress the locked compression spring 79 to push locking shaft 75A inwardly so that the ball 59 then becomes displaced from flight 75B to the smaller shaft flight 75A of the unlocking and locking shaft unit 75. Shaft section 75A allows ball 59 to retract from the ball receiving aperture 57 as the levered cam 20 is rotationally moved towards its unlatching or unlocked position. It should also be noted that as the levered cam 20 moves towards the open position, the tension placed upon jaw section 11A and the of actuating rod 19 is also simultaneously relieved whereupon compression springs 29A & 29B force moveable jaw section 11A to the open position. It is noted that thus there exists a simultaneous movement of jaw 9A as rotational movement (clockwise and counter clockwise) is placed on levered cam 20. The levered cam 20 upon fingered operation rotationally allows the mounting device 1 to be closed and locked simply by movement of lever 23. Unlocking the locked device 1 simply entails depressing the unlocking button while moving the lever 23 of levered cam 20 to release the jaws 9A & 9B from rail 7 thus allowing for quick either attachment of attachment 1 or removal thereof.

It may also be observed from FIGS. 18-21 that any arcuate chamfered ball transport channel 64 in tangential alignment with ball receiving groove 57 of hub 61 effectively serves to transport ball 59 as levered cam 20 is clockwise or counterclockwise rotated about hub 61. This allows for rotational movement about a 90 degree arc.

The mounting of attachment 1 may be adapted to mount onto any type of desired firearm accessory (generally designated as FA) to the firearm F. Thus, common rifle accessories FA normally mounted to a rifle type firearm F may be incorporated into the construction of the mounting attachment 1 herein or adapted for mounting thereto. If the firearm F is not suitably equipped with a forearm mount, rails 7 other suitable forearm mounts 7 may be used to mount the mounting attachment 1 of this invention. The mounting attachment 1 may be equipped with any desired type of mounted auxiliary accessory adapted for the particular type of firearm accessory FA desired to be mounted to firearm mounting attachment 1 of this invention.

Attachment 1
Main body 3
Support Bed 5
Rail 7
Pair of jaw Members 9A & 9B
Projecting ends 11
Biasing unit 29
Actuating pin/rod 19
Levered cam 20
Cam 21
Lever 23
Flanged contacting ends 11A & 11B
Sidewalls 7A & 7B
Rod pin 19A
Compression springs 29A & 29B
Receiving apertures 23A & 23B
Rod stop 31
Spring retaining member 29S
Valley 7V
Rail ribs 7R
Adjusting knob 45
Bolt receiving bore 43
Compression washer 41
Tension pin 53
Cam bushing 55
Ball receiving groove/aperture 57
Locking Ball 59
Pin bore 63
Offset bearing 65
Wear plate 3W
Threaded rod end 19T
Nuts 49
Locking system 40
Longitudinal grooves 7G
Socket 4
Extending joint 9J
Rod aperture 19P
Release button 71
Retaining plate 73
Locking/unlocking shaft 75
Spring plate 77
Release spring 79
Unlatching unit housing 78
Unlatching flight 75A
Biasing member 74
Hub 61
Triangular ridges 7T
Jaw sections 9S Hinging Mechanisms 4 & 9J
Channels 64
Ramped section 7S
Firearms F
Firearm accessories FA

What is claimed is:

1. A firearm forearm attachment which readily detaches, attaches and locks onto a forearm mounting rail of a firearm, said attachment comprising a base member having a channeled bed sized to receive said rail, a pair of oppositely positioned jaw members for engaging onto the rail with at least one jaw member of said pair being a movable jaw section for drawing the jaw members onto the rail to a closed position and withdrawing the jaw members from the rail to an open position, an actuating rod for drawing the movable jaw section against the rail and thereby securely mount the attachment to the rail at the closed position a levered cam operationally connected to said activating rod for drawing the movable jaw section onto the rail to the closed position and withdrawing the movable jaw section to the open position upon a counterrotational movement of the levered cam, and a cam lock section comprised of a ball, a ball socket for seating the ball therewithin to lock the levered cam at a locked position when the levered cam is positioned at the closed position, and a positionable ball release member equipped with a ball release spring which retains the ball release member in a locked ball position by forcing the ball within the ball socket at the closed position with said ball release member upon compression of the release spring serving to release the ball from the ball socket and thereby permit the rotational movement of the levered cam to the open position.

2. The attachment according to claim 1 wherein the ball socket and the ball release member are housed within a housing unit and the ball release member includes a lock release button which upon activation applies a compressive force against the release spring so as to cause the release member to thereby release the ball from the ball socket.

3. The attachment according to claim 1 wherein one of the jaw members is a stationary jaw and the movable jaw section is hinged to a side wall of the base member and the ball release member includes a positionable shaft having a larger shaft section which retains the ball within the ball socket at the locked position and a smaller shaft section which upon a repositioning of the shaft to the smaller shaft section allows for a release of the ball from the ball socket and the movement of the levered cam to the open position.

4. The attachment according to claim 3 wherein the attachment includes at least one jaw compression spring seated within the base member which springs against the movable jaw so as to force the movable jaw section to the open position when the levered cam is placed at the open position.

5. The attachment according to claim 3 wherein the actuating rod is operationally connected at one rod end to the levered cam and communicates through rod receiving aperture disposed within the base member to the movable jaw section at an opposite rod end with said opposite rod end having a pulling stop which upon a predetermined rotational positioning of the levered cam draws and stops the pair of jaws at the closed position.

6. A method for mounting a mountable attachment to a forearm mounting rail of a firearm, said method comprising:

A) procuring the firearm equipped with the forearm mounting rail for mounting the attachment thereto, B) providing the mountable attachment for mounting onto the rail with said mountable attachment comprising a base member having a channeled bed sized for receiving the rail, said base member including a pair of jaw members for securely mounting the mountable attachment to the rail at a closed position with at least one of said pair of the jaw members being a movable jaw section movable to an open position so as to allow an access opening for mounting and detaching of the mountable attachment therefrom, an actuating rod for drawing the movable jaw section onto the mounting rail to the closed position and thereby securely mount the attachment thereto, a levered cam operationally connected to said activating rod for drawing the movable jaw section to the closed position and withdrawing the movable jaw section to the open position so as to thereby permit a disengagement of the pair of jaws from the rail, and a positionable cam lock section which locks the jaw members at the closed position with said cam lock section comprising a ball positionally synchronized to a rotational movement of the levered cam, a ball lock section which upon a seating of the ball therewithin locks the levered cam at the closed position and a positionable ball release member equipped with a release spring and a ball release section which in cooperative association with the release spring retains the ball within the ball lock section at a locked position and upon a compression of the release spring and a repositioning of the ball release member to place the release section in alignment with the ball disengages and unlocks the ball from the ball lock section and thereby enables the levered cam and jaw members to be placed at the open position;

C) emplacing the mounting rail of the firearm within the channeled bed of the mountable attachment with the pair of jaws being positioned at the open position, and D) rotationally moving the levered cam to the closed position to seat the ball within the ball lock section and thereby lock the levered cam and the jaw members at the closed position.

7. The method according to claim 6 wherein the method includes detaching the mountable attachment from the rail by placing a compressive force upon the springed lock release to release the ball from the ball lock section while applying the rotational movement to the levered cam to permit the jaw members to be placed at the open position and thereafter removing the attachment from the rail.

8. The method according to claim 6 wherein the cam lock section includes a housing unit housing a ball passageway within which movement of the ball therewithin is synchronized with the rotational movement of the levered cam, a housing stop equipped with the release spring comprising a compression release spring housed at a distal end of the ball passageway for compressively retaining the ball within the ball lock section and the method includes compressing the release compression spring sufficiently to dislodge said ball from the ball lock section while rotationally positioning the levered cam to the open position and thereafter detaching the mountable attachment from the rail.

9. A mountable attachment mountable onto a forearm mounting rail of a firearm, said attachment comprising a levered cam for transferring a rotational cam movement to a linear motion for drawing at least one movable jaw section of a pair of opposing jaw members together onto the mounting rail to a closed position and thereby securely mount the attachment to the rail and a counterrotation of the rotational movement of the levered cam serves to place the movable jaw at an open position permit a removal of the attachment from the mounting rail, an actuating rod operatively connected to the levered cam and the moveable jaw section so as thereby effectuate movement of the movable jaw section upon the rotational movement of the levered cam and a cam lock section synchronized to the rotational movement of the said levered cam and a locking of the levered cam and the movable jaw section against further movement at the closed position, with said cam lock section comprising a housing unit housing a ball and a positionable release member which locks the levered cam and the ball against further movement at the closed position and releases the ball at the open position with said positionable release member comprising a release spring which forces the ball onto a seated relationship at the closed position, a positionable release shaft having a ball retaining section for retaining the ball at the closed position and a ball release section member which upon applying a compressive force against the release spring and the rotational movement of the levered cam allows the ball to positionally move from the ball retaining section to the ball release section and thereby permit the rotational movement and placement of the said levered cam and the movable jaw at the open position.

10. The attachment according to claim 9 wherein the positionable shaft includes an elevated section which in cooperative association with the release spring biases the ball onto the ball retaining section at the closed position and a recessed section which upon the positionable alignment with the ball dislodges ball from the ball retaining section and thereby permits the rotational movement of the levered cam and the movable jaw to the open position.

11. The attachment according to claim 10 wherein the attachment includes a jaw compression spring which undergoes compression when the movable jaw is placed in the closed position and exerts a compressive opening force upon the moveable jaw section when the levered cam rotates to the open position.

12. The attachment according to claim 10 wherein the attachment includes a base body member having a rail receiving bed sized to seat onto the mounting rail which rail is equipped with a pair of oppositely positioned receiving grooves extending lengthwise along an upper margin of the mounting rail so that when the movable jaw is drawn to the closed position the jaw members becomes securely seated within the grooves.

13. The attachment according to claim 12 wherein the cam lock section includes a ball release button which upon depression moves the release shaft sufficiently to release the ball from a larger ball retaining shaft section to a smaller recessed shaft section, and thereby permit the rotational movement of the levered cam.

14. A mountable attachment mountable to a forearm mounting rail of a firearm, said attachment comprising a levered cam for transferring a rotational cam movement to a linear motion for drawing at least one movable jaw section of a pair of opposing jaw member together onto the mounting rail to a closed position so as to securely mount the attachment to the rail and a reversing of the rotational movement of the levered cam serves to movably draw the movable jaw section to an open position and thereby permit for a removal of the attachment from the mounting rail, an actuating rod operatively connected to the levered cam and the moveable jaw section so as thereby effectuate movement of the movable jaw section upon the rotational movement of the levered cam and a cam lock section synchronized to the rotational movement of the levered cam which cam lock section includes a locking stage for locking the levered cam against further rotational movement upon placement of the movable jaw section at the closed position, with said cam lock section comprising a housing unit housing a ball, a ball passageway, a positionable shaft having a ball retention section and a ball release section, and a compression release spring housed at a distal end of the housing unit with said release spring forcing the ball onto the ball retention section at the closed position with said shaft being operably connected to a release button which upon an application of a compressive force causes the release spring to compress and the positional shaft to move sufficiently to replace ball retention section with said ball release section and thereby permit access of the ball to the passageway and placement of the levered cam at the open position.

15. A firearm mounting attachment combination comprising a rifle equipped with a rail mounted to a rifle forearm with said rail including longitudinally extending channeled sidewalls embedded therewithin and an attachable and detachable rail attachment attached to the rail, said rail attachment comprising a supportive body, a pair of opposingly positioned jaw members equipped with flanged tips for securely seating onto the channeled sidewalls of said rail when said pair of jaw members are drawn to a closed position with at least one of said pair of jaws being a hinged jaw hingeably mounted to said body, a push-pull activating rod for pulling the jaws together to the closed position and a withdrawal of the jaw members to an open position when the rod pushes the hinged jaw to the open position, a lever operated cam operationally connected to the activating rod to provide movement of the jaws to the closed position and the open position and a cam lock section comprised of a ball positionally synchronized to the rotational movement of the levered cam, a ball retaining section which upon a seating of the ball therewithin locks the levered cam and the jaws against further movement at the closed position so as to securely mount the attachment to the rail and a springed ball lock release which compressively seats the ball within the ball retaining section at the closed position which lock release upon an application of a compressive force against a ball retention member and the rotational movement of the levered cam disengages the ball from the ball retaining section and thereby allows the levered cam and the jaw members to be placed at the open position.

16. A firearm attachment combination, said combination comprising a firearm equipped with a mounting rail and a mountable attachment mounted to the rail, said mountable attachment comprising a levered cam for transferring rotational movement to a linear motion for drawing a pair of opposing jaw members to a closed position and thereby securely mount the attachment to the mounting rail and to withdraw the jaw members to an open position so as to permit a removal of the attachment from the rail with at least one of the jaw members being a movable jaw section responsive to the rotational movement of said levered cam, an actuating rod synchronized and operatively connected to the levered cam for placing the movable jaw section at the open position and the closed position, a cam lock section synchronized to the rotational movement of said levered cam with said cam lock section comprising a housing unit housing a ball positionally synchronized to the rotational movement of the levered cam, a positionable ball seating socket, a ball passageway which provides an accessing passageway for the ball when the ball is released from the ball seating socket, a release spring which forces the ball onto the ball seating socket with said cam lock section upon a positioning of the ball in a locking alignment to said ball seating socket locks the levered cam and the movable jaw member at the closed position and a positionable lock release member in operative communication with said release spring serving to release the ball from the ball seating socket by applying sufficient compression to compress the release spring and replace the ball seating socket with the ball release member and thereby dislodge the ball from the ball seating socket and permit the rotationally movement of the levered cam to the open position.

17. The combination according to claim 16 wherein the moveable jaw section operatively engages onto a jaw spring which forces the movable jaw section to the open position upon the rotational movement of the levered cam to the open position.

18. The combination according to claim 17 wherein the jaw spring comprises a compression jaw spring for exerting a compressive force upon said movable jaw section.

19. The combination according to claim 16 wherein the attachment includes a base member having a rail receiving bed sized to seat onto the mounting rail with said mounting rail having a channeled groove extending longitudinally along an upper margin of the mounting rail so that when the jaw members are drawn to the closed position the jaw members securely anchor the attachment to the mounting rail.

20. The combination according to claim 16 wherein the cam lock section includes a positionable shaft having a ball retention member which retains the ball in a ball locked position and releases the ball at a ball release position, and a ball release button in operational communication with the ball retention member, which said release button upon compressive force thereupon serves to compress the release spring sufficiently to allow movement of the shaft to the ball release position and thereby permit passage of the ball onto the passageway and the rotational movement of the levered cam.

21. A firearm mounted attachment combination comprising a firearm equipped with a mounting rail and a mountable attachment mounted thereto, said mountable attachment comprising a levered cam for transferring rotational cam motion to a linear motion for drawing a pair of opposing jaw members to an open position and a closed position with at least one of the opposing jaw members being drawn to the closed position upon a rotational movement of the levered cam in one direction so as to securely mount the attachment to the rail and upon an opposite rotational movement of the levered cam causing the jaw members to move to the open position and thereby permit a removal of the attachment from the mounting rail, an actuating rod operatively connected to the levered cam so as thereby effectuate movement of at least one movable jaw section of the jaw members upon the rotational movement of the levered cam, a cam lock section synchronized to the rotational movement of said levered cam with said cam lock section including a locking stage for locking the levered cam and the movable jaw member against further rotational movement with said lock section being synchronized to lock the jaw section upon a closure movement of said pair of jaw members to the closed position and a lock release which unlocks said jaw section from the locking stage and thereby permit the rotational movement of said levered cam with said lock section comprising a locking socket and a ball which when rotationally positioned in a locking alignment with said locking socket locks the levered cam against the further rotational movement and a ball release button which ball release button upon a sufficient lock releasing depression provides access onto an open passageway for releasing the ball from said locking socket so as thereby permit the rotational movement of the levered cam.

22. The combination according to claim 21 wherein the combination includes the mounted attachment equipped with a bipod mounted to the underside of the firearm.

23. The combination according to claim 21 wherein the mounted attachment includes a rifle scope mount for mounting a rifle scope to the attachment.

24. The combination accordingly to claim 23 wherein the combination includes a rifle scope mounted to the rifle scope mount.

* * * * *